United States Patent [19]

Fulk

[11] 3,951,631

[45] Apr. 20, 1976

[54] APPARATUS FOR COATING CONTINUOUSLY PRODUCED GLASS FILAMENTS

[75] Inventor: Walter F. Fulk, Newark, Ohio

[73] Assignee: Owens-Corning Fiberglas Corporation, Toledo, Ohio

[22] Filed: Aug. 19, 1974

[21] Appl. No.: 498,492

[52] U.S. Cl. ..... 65/11 W; 65/3 R; 118/261

[51] Int. Cl.[2] ..... C03C 25/02

[58] Field of Search ..... 65/11 W, 3; 118/261

[56] References Cited

UNITED STATES PATENTS

| | | | |
|---|---|---|---|
| 2,723,215 | 11/1955 | Biefeld et al. | 65/11 W X |
| 2,895,789 | 7/1959 | Russell | 65/3 |
| 3,294,060 | 12/1966 | McIntyre et al. | 118/261 |
| 3,676,096 | 7/1972 | Schuller et al. | 65/3 |

*Primary Examiner*—Arthur D. Kellogg
*Attorney, Agent, or Firm*—John W. Overman; Charles R. Schaub

[57] ABSTRACT

Apparatus for applying liquid coating or sizing material to fibers where the body of the applicator has a passageway with an elongated outlet and an exterior groove adjacent the outlet. A rotatable applicator roll, for supplying the sizing to glass fibers, is positioned in the exterior groove of the body so that a portion of the roll projects beyond the open end of the groove adjacent to the outlet. There is a means for rotating the applicator roll in a direction such that the circumferential surface of the roll moves away from the groove at the outlet. There is also a means for supplying liquid coating or sizing under pressure to the passageway of the body. The sizing then is discharged through the outlet onto the circumferential surface of the applicator roll as the surface moves away from the groove during rotation.

47 Claims, 10 Drawing Figures

APPARATUS FOR COATING CONTINUOUSLY PRODUCED GLASS FILAMENTS

BACKGROUND OF THE INVENTION

The present invention relates to the application of coating or sizing material to fibers. The sizing material is preferably a gel or other higher viscosity material. The apparatus of this invention applies the sizing to the glass filaments at forming.

The technology which has been developed for the production of glass fibers, presently makes possible the production of fibers having a diameter of from approximately 0.0001 inch to approximately 0.0004 inch, at a rate of from approximately 4,000 feet per minute to approximately 15,000 feet per minute. Glass fibers are produced from small streams of molten glass which exude through tiny orifices located in what is called a forming position. Conventionally, forming positions have 204 such orifices. The tiny streams of molten glass which issue from the bushing are attenuated by pulling the fibers until the diameters given above result, and during which time the streams cool and rigidify into what are called filaments. These filaments are then coated with a protective film for the purpose of preventing glass to glass abrasion, and following which they are brought together to form a strand. This strand is coiled upon a tube to form a package. During formation of the package, the strand is traversed back and forth across the tube by a device which is called a traverse, and which is located between the point where the coating materials are applied, and the rotating tube on which the package is made. The tube is rotated by what is called a collet, and the pulling action supplied by the collet attenuates the molten streams of glass, pulls the filaments past the coating applicator, and through the traverse, and coils the strand onto the package. The winder is usually located approximately 10 feet from the bushing, so that the entire forming operation is carried out in a fraction of a second.

The problem of abrasion of glass upon glass is a serious one and has generally been a controlling factor in the rate at which this technology has developed. The seriousness of the problem has caused the wide spread theory that glass to glass abrasion can only be prevented by a solid film of material between the filaments to at all times assure physical separation of the filaments. Regardless of the validity of this theory its acceptance by the art has not caused the art to develop a coating which is completely satisfactory under all conditions for use in separating the filaments during forming. Where the strands are to be woven into textiles, it will be apparent that the amount of film forming materials which can be used must be held within certain percentages of the total weight of the strand in order that the strand will not be unduly stiff. Dyes will not color the glass itself, and so the coatings which are used must either be capable of being dyed, or must be capable of being removed, and later replaced by a material capable of being dyed. Where the glass is to be used for reinforcing plastic materials, the bond between the coatings and the glass filaments is very important, as well as the compatibility of the coating with the later applied resin which the coated strand is intended to reinforce.

The technology in its forty some years of existence has examined all types of materials for their suitability as coatings on glass fibers in an attempt to find one which is "universal" in that fibers coated therewith can be used for all known subsequent uses of coated glass strand. The art has tried all kinds of resins, either as emulsions, or as solutions in organic solvents, but all lack some desired characteristics, and usually suffer from high tensions during weaving operations. In addition, organic solvents create explosion hazards that require expensive equipment to overcome. In general, resins and other materials requiring organic solvents have not been better than coating materials which are soluble in aqueous media, so that the art has substantially universally used coating materials soluble in water. By and large, the most commonly used coating materials for protecting glass fibers during the forming operation comprise starch in some form. Although starch is not durable to the degree that it can stay in place on the filaments and provide protection after the fibers are woven, it has been without equal in its protection of the strands during the various abrasion producing operations that are involved preparatory to, and during weaving. In addition, methods have been developed, usually burning, which are quite satisfactory for removing the starch after weaving, so that any desired finish coatings can then be applied. The art has long desired to replace starch base coatings, which are only temporary in nature, with a single coating material which would perform as satisfactory as starch base materials during forming, and which would also act as a finish sizing which is capable of being dyed and which will permanently protect the filaments during use. The art would further like this coating material to be a "universal" one, so that it can be used regardless of the end use of the strand. Such a universal coating material for glass fibers has never been developed, and there is considerable belief in the art that one will never be developed, because of the great number of properties which such a material must have.

Coating materials, including starch base coating materials, must be quite fluid when applied to the filaments, in order that the coating materials will completely cover or "wet out" the filaments in the short length of time that exists before they are brought together into a strand. The amount of "solids" that can be applied to the filaments, therefore, is limited by the degree of fluidity necessary to "wet out" the filaments. It is not possible to apply fluid coating materials in an amount which will completely "wet out" the strands without having an excess present, and a high percentage of the coating fluids brought in contact with the filaments is thrown into the surrounding area as a spray. In addition, the coating collects at different areas of the applicator and winding equipment which then either drips or is thrown to the floor. In all prior art processes with which applicants are aware, the degree of fluidity required necessitates that the coating fluids have only a small percentage of solids, and a high percentage of the coating materials that are carried with the strand into the coiled package is the solvent. The coiled packages of strand which are produced, must be dried prior to subsequent twisting and weaving operations, and during this drying operation, the movement of the fluid or solvent migrates to the surface of the package and carries along with it some of the solid materials which form the coating. This movement of the solid materials with the solvent is commonly called "migration." The art has long been concerned with the problem of migration and a considerable number of patents have been concerned solely with this single problem.

To solve this problem it has been proposed to apply existing coating materials to glass filaments at forming as a thixotropic gel. When a thixotropic gel is applied to a pad type applicator by hand, and the filaments pulled therethrough, a suitable coating can be produced, but the supply of material on the pad cannot be replenished in the usual manner, and no known apparatus is suitable. When a belt type application, as for example that shown in the Brastigam Pat. No. 2,873,718, is used for application of the gel to the filaments, an uneven coating is produced with some portion of the filaments being uncoated. When uncoated portions of the filaments are drawn together, the strand breaks. In addition, gel collects at various points of the equipment and is either carried along with the filaments to the package as globs, or drops to the floor of the surrounding area. Air bubbles are dispersed throughout the gel and are carried to the glass filaments, with the result that whenever the filaments are drawn through an air bubble, they are uncoated and subsequently break. When an applicator such as shown in the Ewing Pat. No. 3,244,143 is used, air bubbles are also carried along with the gel to the glass filaments with the result that the filaments are uncoated and subsequently break.

A recent development has been the use of a roll type applicator for applying thixotropic gel sizings. The roll applicator apparatus comprises a support-mounted applicator roll rotatable about a central axis, a pressure confining feed passage discharging tangentially across the width of the roll at the gel pick-up zone, and a smooth shearing surface opposite the surface of the roll for contacting the gel conveyed by the roll. The smooth shearing surface is used to change the thixotropic gel into a partial liquid before the filaments come into contact with the gel. This liquefying step helps the thixotropic gel coat the filaments. However, the smooth shearing surface also tends to limit the types of sizing that can be used in the applicator. Sizings that are not thixotropic in nature do not need to be liquefied by contacting a shearing surface. In fact, the shearing surface just provides another area where the sizing can accumulate and where other problems can arise when non-thixotropic sizings are used. Thus, this type of applicator is unsuitable unless thixotropic sizings are being applied to filaments.

The thixotropic roll applicator also uses a fairly small diameter roll. The roll has a tendency to wobble when in use. This results in a non-uniform application of thixotropic sizing to the filaments. The roll in this applicator is also rather fragile and is easily broken during routine maintenance. As the roll is not very sturdy its length was kept as small as possible. This helped to increase the life of the roll. However, this limits the applicator to coating the filaments from only one filament forming position.

SUMMARY OF THE INVENTION

An object of the invention is improved apparatus for any method of treating linear material with a coating substance.

Another object of the invention is improved apparatus for and method of applying a coating substance to multifilament linear material.

Yet another object of the invention is improved apparatus for and method of more uniformly coating multifilament linear material.

An additional object of the invention is improved apparatus for and method of producing glass strand.

Another object of the invention is improved apparatus for and method of reducing the amount of coating substance waste.

Still another object of the invention is increasing the useful life of the applicator roll.

Another object of the invention is improved apparatus for and method of coating filaments with thixotropic and other coating or sizing materials.

Yet another object of the invention is improved apparatus for and method of coating the filaments from more than one filament forming position.

Still another object of the invention is to provide a wobble free applicator roll.

In a broad sense these and other objects of the invention are attained by apparatus having an elongated outlet and an exterior groove. An applicator roll is positioned in the groove so that a portion of the roll projects beyond the open end of the groove adjacent to the outlet. This is a means for supplying coating or sizing material under pressure to the outlet. The sizing material flows out of the outlet in a uniform sheet and is deposited on the circumferential surface of the applicator roll. When the filaments are advanced, while in contact with the roll, they are uniformly coated with the sizing material.

Other objects and advantages of the invention will become apparent as the invention is described hereinafter in more detail with reference made to the accompanying drawings.

DESCRIPTION OF THE PREFERRED EMBODIMENTS

The method and apparatus of the invention are particularly useful in processes of forming filaments of heat-softened mineral material such as molten glass. In these processes apparatus a liquid coating or sizing material is applied to individual glass filaments and the glass filaments combined into an untwisted filament bundle or glass strand that is wound onto a package. But the method and apparatus of the invention are useful in other processes that treat other types of linear material (for example, filament bundles such as yarn, cord, roving etc. as well as monofilaments) made from glass or other filament forming material such as nylon and polyester. Thus, disclosure discolsure of treating and packaging glass strand in a glass filament forming operation is only an example to explain the operation of the invention. And the term linear material used in the specification and claims includes monofilaments and filament bundles, including bundles of continuous or discontinuous synthetic filaments with or without twist, in addition to bundles of natural filaments.

Figure 1:
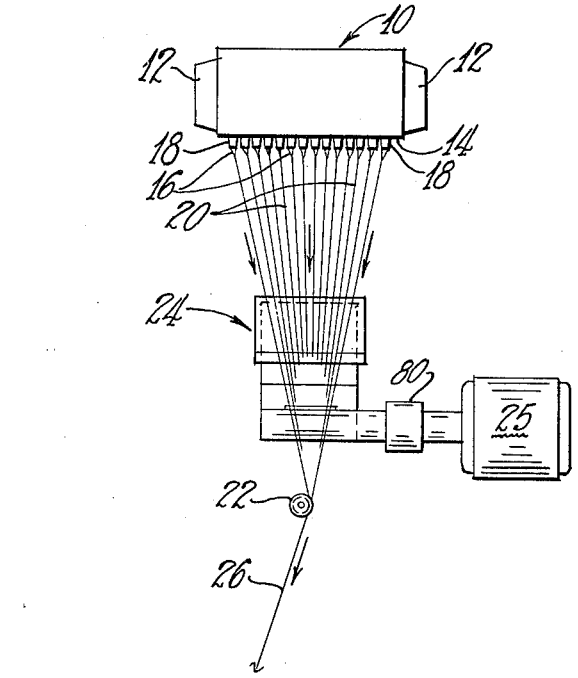
FIG. 1 is a front view of the applicator in operation.
Figure 1:
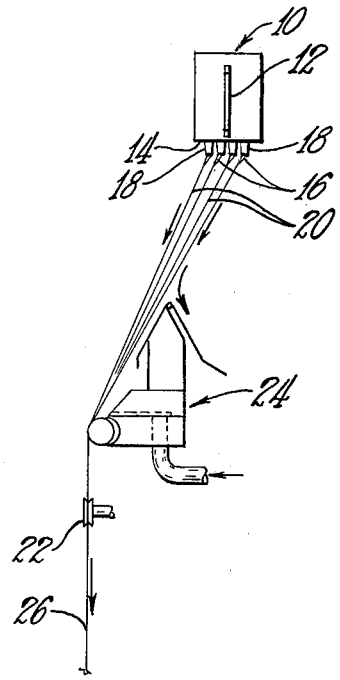
Figure 1:
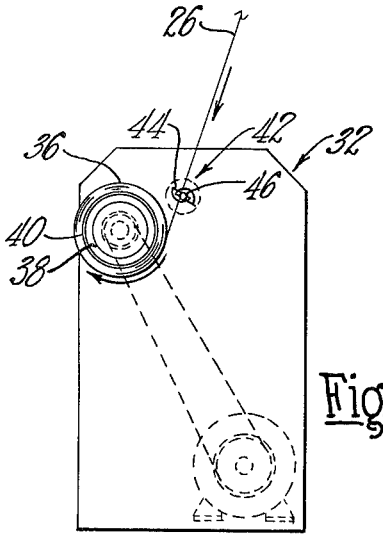
Figure 2:
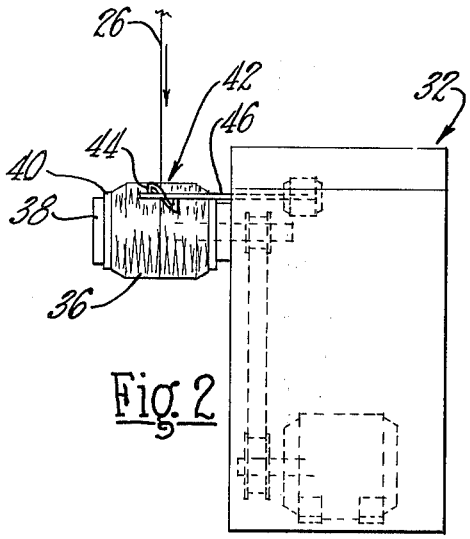
FIG. 2 is a side view of the applicator during operation.

FIGS. 1 and 2 show a process of forming continuous glass filaments. The glass filaments 20 are passed over an applicator 24 that deposits a liquid sizing material on the filaments. The filaments 20 are then combined into an untwisted filament bundle or strand 26 that collects as a wound package 36. As illustrated, a container 10 holds a supply of molten glass. The container 10 may connect a forehearth that supplies molten glass from a furnace. A melter for reducing marbles to a heat-softened condition may also be associated with the container as a source of molten glass. Terminals 12 on the end of the container 10 are connected to a source of electrical energy. This energy is used to supply conventional resistance heating to the glass held in the container 10. The supply of heat is necessary to maintain the glass at proper fiber forming temperatures and viscosities.

The container 10 has orifices or passageways in its bottom wall 14, for delivering streams of molten glass. As shown in FIG. 1 the opening in the bottom wall 14 comprises rows of spaced apart depending orificed projections or tubular members 18.

The molten streams 16 are attenuated into individual spaced apart continuous glass filaments 20. The filaments advance downwardly together at high linear speed along converging paths. An applicator 24 is positioned along the paths of filament travel to apply a liquid sizing material to the individual filaments 20. The paths of the filaments 20 converge at the gathering member 22 to form a strand 26.

A winder 32 collects the treated strand 26 as a wound package 36 on a driven rotatable collet or mandrel 38. The package 36 forms on a collector such as a tube 40 telescoped onto the collet 38.

The pulling force of the winder attenuates the glass streams 16 into continuous glass filaments 20.

Strand traversing apparatus 42 moves the advancing strand 26 back and forth axially on the package 36 to distribute the strand 26. In spiral embodiment shown the traversing apparatus 41 includes a "spiraal wire" 44 on a driven shaft 46. U.S. Pat. No. 2,391,870 describes the operation of a "spiral wire" traverse arrangement.

The movement of the filaments 20 draws a considerable amount of air with them from the surrounding atmosphere. The arrows in FIGS. 1 and 2 generally indicate the air flow direction.

Figure 3:
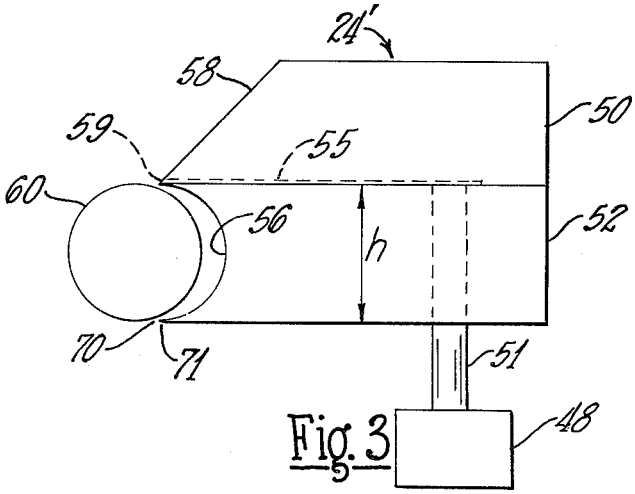
FIG. 3 is a side view of just the applicator.
Figure 4:
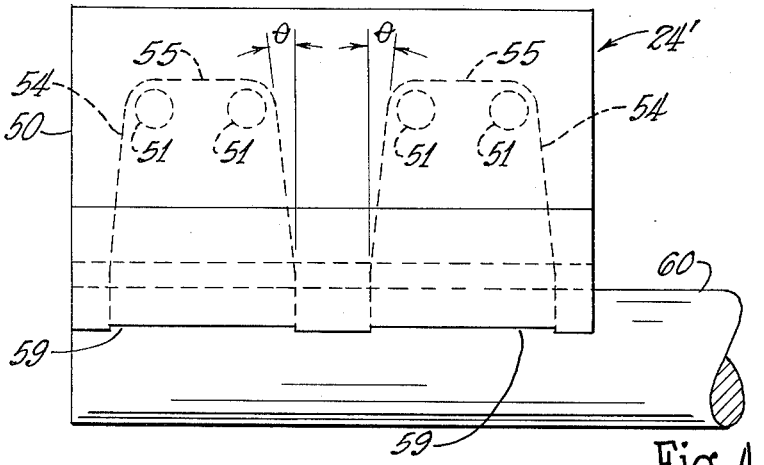
FIG. 4 is a top view of the applicator.
Figure 5:
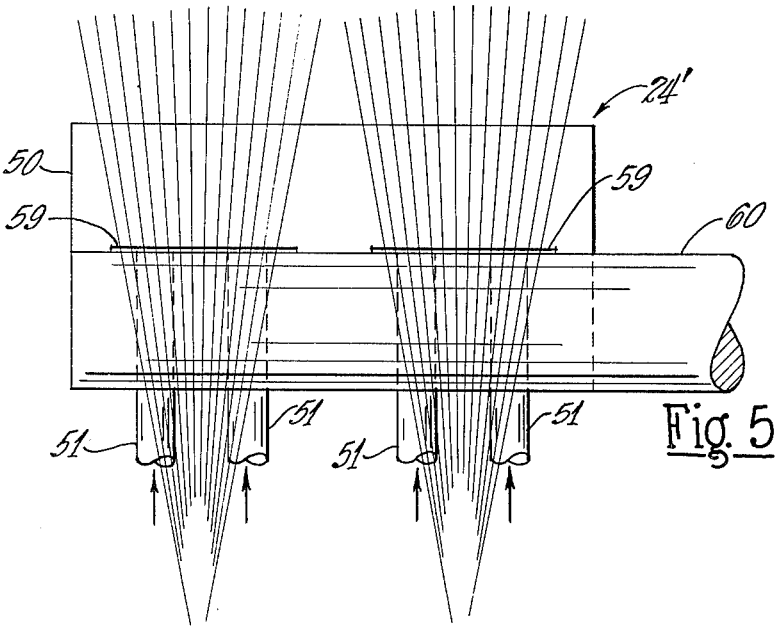
FIG. 5 is a front view of the applicator showing how the filaments are coated.

The applicator 24' for applying liquid size material to the filaments 20 is more clearly shown in FIGS. 3, 4 and 5.

The applicator 24' has a top block 50 and a bottom block 52. The top block 50 and bottom block 52 are secured together by any suitable fastening device (not shown).

In one surface of the top block 50 there is a passageway or chamber 55. The passageway 55 extends to the front face 58 of the top block 50 and terminates in an elongated outlet 59. The passageway 55 is connected to a source of liquid sizing material by passageway 51 that passes through the bottom block 52. The liquid sizing material is supplied to the passageway 55 by a pump 48. In a broader sense when the top block 50 and the bottom block 52 are combined they form a hollow body. And the hollow position of the body forms the cavity or passageway 55.

The passageway 55, the outlet 59 and the passageway 51 can be cleaned by unfastening the top 50 and bottom 52 blocks. This exposes the passageway and the outlet and makes them easy to clean. The applicator 24' can then be put back into operating condition by refastening to top block 50 to the bottom block 52.

The bottom block 52 has an exterior groove 56 along one lateral edge. The groove 56 is semi-circular in shape and has a diameter that is the same as the height (h) of the bottom block 52. A rotatable applicator roll 60 is positioned in the groove 56. A portion of the roll 60 projects beyond the open end of the groove 56 adjacent the outlet 59. The diameter of the roll 60 is the same as the diameter of the groove 56. The roll 60 is rotated by a motor 25 (see FIG. 1).

In operation a liquid sizing material is supplied to passageway 55, through passageway 51, by a pump 48. The coating or sizing material exits through the elongated outlet 59 on to the applicator roll 60. Filaments 20 are then drawn over the rotating applicator roll 60 and coated with the liquid sizing material. The filaments are gathered into a strand 26 and collected into a package 36.

During operation the liquid sizing material should flow out of the elongated outlet 59 as a thin sheet or film. This thin sheet or film of sizing is then deposited on to the roll 60. The sizing is applied to the top area of the roll 60 that projects out of the groove 56. As the roll 60 rotates it immediately moves the sizing away from the top block 50 of the applicator 24'. Thus, once the sheet of sizing material is applied to the roll 60 it is not disturbed until the filaments 20 remove the sizing.

It is necessary to have a uniform thin sheet of sizing on the roll 60 to assure that the filaments 20 will be uniformly coated. Any gaps in the sheet of sizing material will disrupt the uniform coating of the filaments 20. If there are any uncoated spots on the filaments 20 there will be glass upon glass abrasion when the filaments 20 are gathered into a strand 26. The problem of glass upon glass abrasion is a serious one as it weakens or even breaks the filaments. Therefore, to avoid this problem it is necessary that the filaments 20 be separated by a layer of sizing material when they are gathered into a strand 26.

The liquid sizing material used with the applicator 24' is usually a high viscosity liquid or even a gel. Sizings classified as thixotropic are very suitable for this applicator 24' as are other sizings that can be applied in a thin sheet. Thixotropic sizings are gels at ambient conditions when allowed to assume static conditions. When a shear stress of sufficient magnitude is applied to these gels, they revert to solutions; and when the shear stress is removed, they immediately revert back to a gel.

It has also been found that sizings other than thixotropic sizings will work in the applicator 24'. These sizings must, however, have a viscosity high enough that they can be applied as a thin sheet to the roll 60. The applicator 24' works better when the viscosity is high enough that the sizings do not flow in a direction opposite to the direction of rotation of the roll 60. The sizing must retain its position on the rotating roll 60 until it comes into contact with the advancing filaments 20. This is necessary to ensure that a uniform sheet of sizing will be available to coat the filament 20. For example, it has been found that a sizing with a viscosity of 200 centipoise or higher exhibits the characteristics to make it suitable for use in this applicator 24'.

However, these sizings have a tendency not to completely fill the passageway 55, because of their high viscosity. The sizings tend to channel in a narrow area instead of completely filling the passageway 55. If the sizing does not completely fill the passageway 55 there will be dry spots on the roll 60 and some filaments 20 will not be coated with sizing. Therefore, the design of the passageway 55 must prevent the sizing from channeling. To eliminate channeling the sides 54 of the passageway 55 should not flare out very quickly from the passageway 51. This will allow the sizing material to follow along the sides 54 of the passageway 55.

It has been found that the angle $\theta$ (see FIG. 4) made by the side 54 should be between 35°– 48° to prevent channeling of the sizing. Another design feature that is useful in eliminating channeling is making approximately the last ⅛ inch of the side 54, in the vacinity of the outlet 59, perpendicular to the outlet 59. In addition, all corners in the passageway 55 should be radiused to help eliminate channeling.

The passageway 55 is formed when the top block 50 is fastened to the bottom block 52. The bottom block 52 provides the bottom wall of the chamber 55. However, the bottom block 52 is not as long as the top block 50. Therefore, at the outlet 59 end of the top block 50 there is a hole in the bottom of passageway 55. The hole is a slot along the length of the outlet 59. The width of the slot is approximately .002–.006 inch. Thus, some of the liquid sizing material will pass through this slot and on to the applicator roll 60.

The elongated outlet 59 should be small enough that the volume of liquid sizing material that the pump supplies will completely fill the outlet 59. This will result in a uniform sheet of material being supplied to the applicator roll 60. If the volume supplied by the pump 48 is varied substantially the size of the outlet 59 may also have to be changed. It has been found that an outlet with a height of .02 of an inch and a length of 4.12 inches works very satisfactorily for most sizings.

It should also be noted that the outlet 59 may have almost any shape that will supply a uniform sheet of sizing to the roll 60. The outlet 59 does not have to be rectangular as shown in the drawings.

During the operation of the applicator 24' it is necessary that the roll 60 be free to rotate. However, the roll 60 and the groove 56 that it is positioned in are the same size. Therefore, to allow for rotation it is necessary to displace the roll 60 away from the groove 56. This creates restricted regions or spaces 70 between the roll 60 and the groove 56 that allows the roll 60 to rotate freely while still having the roll 60 in close relationship with the groove 56 to remove foreign material from the roll.

An acceptable space 70 can be created by displacing the center of roll 60 approximately .015 of an inch out from the center of the groove 56. This results in spaces 70 that are approximately .005 of an inch.

Figure 6:
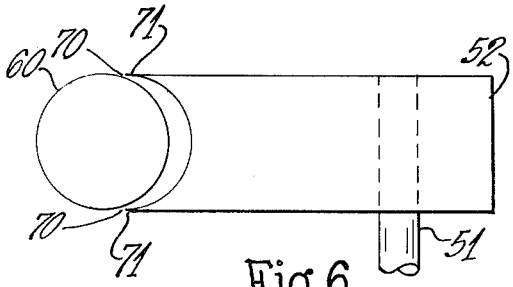
FIG. 6 is a side view of a portion of the applicator that better shows the relationship between the groove and the roll.

Edges 71 (FIGS. 3 and 6), at the exterior region of the groove 56, are created by the displacement of the roll 60. The edges 71 act as a scrapper and guard to keep foreign material from building up behind the roll 60 in the groove 56. The foreign material can be sizing or filaments 20 that stick to the roll 60 and are carried around into the groove. The foreign material can also be sizing that drips from the outlet 59 into the groove. It is very undesirable to have a build up of sizing or filaments 20 behind the roll 60. These materials can dry behind the roll 60 and prohibit its rotation or create irregularities in the surface of the roll. The build up of foreign material behind the roll 60 is clearly an undesirable situation.

The edges 71 also act as an air barrier. The liquid sizing material picks up a layer of air from the advancing filaments. Since the sizing material is viscous the layer of air follows the movement of the sizing material. Thus, the air will follow the sizing as it travels on the roll 60. If all the sizing material is not removed from the roll 60 the air will follow along roll 60 into the groove 56. When a new layer of sizing is applied to the roll 60 there will be a layer of air already on the roll 60. This layer of air will be trapped in the new sizing material. The trapped layer of air will cause dry spots and air bubbles on the roll 60. When the filaments 20 are drawn over these dry spots of air bubbles they will not be coated with sizing material. The uncoated filaments 20 will then be subject to glass upon glass abrasion when they are gathered into a strand 26.

The edges 71 help to prevent the layer of air from staying with the sizing as it rotates around on the roll 60. The edges 71 act as an air barrier and divert the air away from the roll. This prevents the air from entering the groove 56 and being covered with a layer of sizing material.

For the edges 71 to act as a scrapper and air barrier it is important that the spaces 70 be as small as possible. The only limitation on the size of spaces 70 is that they must be large enough to allow the roll 60 to rotate. By having the spaces 70 as small as possible this maximizes the scrapper effect of the edges 71. This helps in providing a more uniform coating for the filaments 20.

It has been found that a ¾ of an inch diameter roll 60 functions very well. The roll 60 is already usually made of graphite. However, other sizes and materials can be utilized for the roll. The linear surface speed of the face of the roll 60 of approximately 10 feet per minute. The roll 60 is usually rotated in the direction that the filaments 20 are traveling. The linear speed of the advancing filaments 20 is 4,000 – 15,000 feet per minute. Thus the filaments 20 are traveling much faster than the face of the roll 60. This results in a large area of filaments 20 being supplied with sizing from one location on the roll. This is called a wipping action of the filaments 20 on the roll 60.

The roll 60 is normally rotated by a motor 25 (see FIG. 1). The motor must be able to keep the roll 60 rotating at a constant speed to promote uniform coating of the filaments. The motor 25 is usually positioned beside the applicator 24' so it is not under the filament forming position. Thus, the motor 25 is not in a position where it blocks the flow of air being carried along with the filaments 20. It also removes the motor 25 from some of the messy areas of filament forming.

Although the roll 60 is usually rotated by a motor 25 it can also be rotated by the advancing filaments 20. The speed of the filaments 20, as they advance across the roll 60, will impart rotation to the roll 60. This rotation can be adequate for coating the filaments 20.

As the filaments 20 advance across the roll there must be adequate sizing material available for coating. This operation is complicated by the fact that the filaments 20 are traveling faster than the face of the roll 60. There must be enough sizing material supplied to the roll 60 to coat a length of filaments 20. Thus, a sheet of sizing material thick enough to coat a desired length of filaments must be supplied to the roll 60. It is also desirable to have the sheet of sizing material removed completely from the roll 60 by the filaments 20. If all the sizing is not removed from the roll 60 it drips off onto floor. This is an expensive and messy waste of sizing material.

To prevent the waste of sizing it is necessary to supply just the right amount of sizing to the roll 60. The preferred way to control the sizing supply is to control the amount of sizing pumped to the outlet 59. This can be done very effectively by using a pump 48 (see FIG. 3) to supply the sizing to the outlet 59. In the preferred embodiment the pump 48 is a positive displacement pump. This insures that a constant amount of sizing will be supplied to the outlet 59. And that a uniform sheet of sizing will be present on the roll 60 to coat the filaments 20.

The roll 60 (FIG. 1) is shown mounted in a cantilevered fashion. In this arrangement the roll 60 is supported by bearing 80. By using a cantilevered mounting large bearings 80 can be used to support the roll 60. Also the bearings 80 can be removed from the area where the binder material is applied to the roll 60. This reduces chance of sizing material clogging the bearings 80. Also in this system only one bearing assembly 80 has to be replaced on the roll 60. This makes maintenance on the roll 60 much easier.

The applicator of the invention allows coating of filaments coming from more than one filament forming position. The longer lengths of the roll 60 can also be used on high output filament forming positions. These positions have long fin shields around the orifices 18 to increase the output of the forming position. However, the longer fin shields prevent the filaments from being quickly gathered into a strand. If the filaments are gathered together too quickly, they will hit the edge of the fin shields. This will damage or break the filaments. Consequently a longer roll 60 is required on this type of high output forming position to accommodate the wider array of filaments.

To change the length of the roll 60 it is necessary to replace the roll. Since the roll 60 is cantilever mounted it is disconnected at one point and removed from the applicator. The new roll 60 is placed in the applicator and reconnected. This simple procedure is all that is necessary to change the roll 60. It should also be noted that the alignment of the roll 60 does not change during this procedure as there is no need to move the bearings that support the roll 60.

The combination of the larger bearings and the larger roll help to prevent the applicator roll 60 from wobbling. In past applicators of this type there was a tendency for the applicator roll to wobble. When the roll wobbled it would move away from source of the sizing material. This would result in a build up of sizing material at its outlet. At the same time the roll would be without sizing material. Thus, filaments that passed over the roll would not be coated with sizing material. When the roll wobbled back in the direction toward the outlet it would pick up the excess sizing that had been building up. The roll then would have too much sizing material on it and sizing would be wasted. The applicator of this invention has overcome the problem of wobble by using a larger more rigid roll and larger bearings to support the roll.

Although the roll 60 has been shown to be cylindrical and the groove to be semi-circular these are only examples. The roll 60 can be any elongated member that is rotatable. And a channel of almost any shape can be used for the groove.

However, the exterior edges 71 of the groove must act as a scraper. Also the clearance 70 between the roll and groove should be as small as possible while allowing the roll to rotate.

Figure 7:
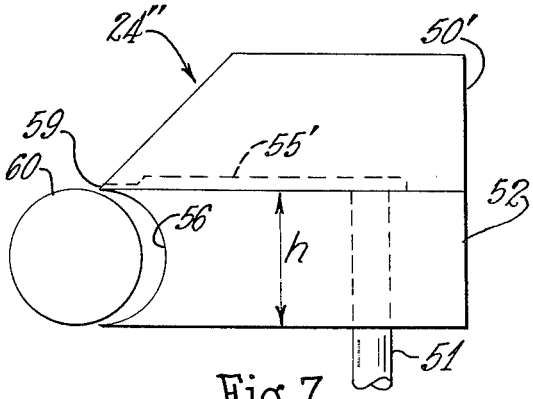
FIG. 7 is a side view of an applicator with a different shaped passageway for the liquid coating material.

FIG. 7 shows an applicator 24'' that has a sizing passageway 56' that has a different shape. The passageway 55' has been made larger by increasing the height. This will allow more sizing material to be pumped into the passage 55'. Since the sizing used in this applicator is usually a gel it has a tendency to channel. This means that the sizing does not completely fill the passageway 55'. A uniform amount of sizing will not be supplied to the roll 60 if the sizing is allowed to channel. This could result in filament breakage as some of the filaments will not be coated with protective sizing material. Therefore, it is very important that the passageway 55' be designed to prevent channeling of the sizing material.

The main function of the passageway 55 or 55' is to supply a uniform amount of sizing material to the outlet 59. The sizing material must completely fill the outlet 59 and become a uniform sheet on the roll 60. This allows all the filaments 20 to be completely coated with protective sizing material. Therefore, any shape can be utilized for the passageway if it provides a suitable amount of sizing to uniformly coat the filaments.

Figure 8:
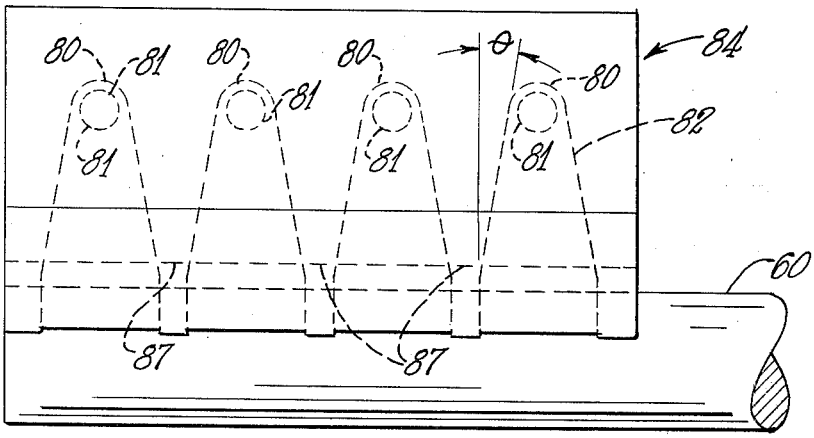
FIG. 8 is a top view of an applicator with four passageways for supplying liquid coating material to the roll.
Figure 9:
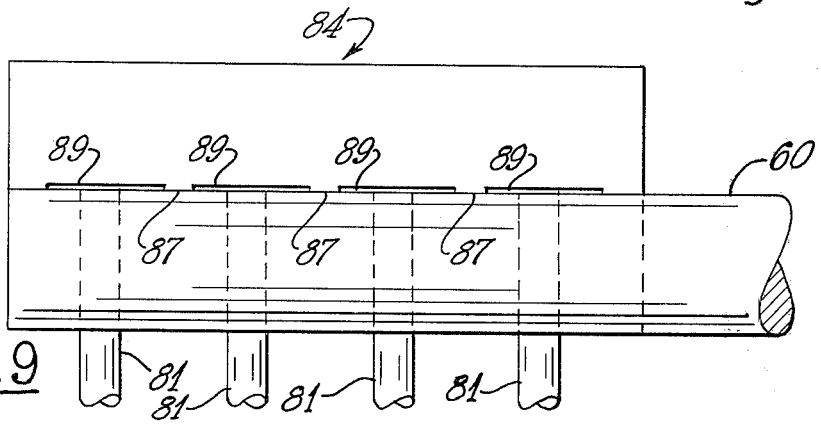
FIG. 9 is a front view of an applicator with four passageways for supplying liquid coating material to the roll.

FIGS. 8 and 9 show an applicator 84 with a different system for supplying sizing to the roll 60. The outlets 89 are only wide enough to coat one-half of the filaments 20 that are attenuated from a fiber forming position. Thus, it requires two outlets 89 to coat the filaments from one filament forming position. There are small (⅛ of an inch) spaces 87 between the outlets 89. These spaces 89 do not interfere with the coating of the filaments 20. This is because a normal row of orifices used to attenuate filaments has a support in the center. The support is there to prevent the bottom wall of the molten glass container from sagging. The support in essence divides the filaments being attenuated from the orifices into two separate groups of filaments. The support corresponds in position to the spaces 87. When two outlets 89 are used to coat filaments the spaces 87 between the outlets 89 corresponds with the separation between the two groups of filaments. Thus, the two outlets 89 supply the roll 60 with just enough sizing material to coat the filaments 20 from one forming position.

Each of the passageways 80 have there own source of sizing material supplied through passageway 81. Therefore, each outlet 89 has an independent supply of sizing material. When coating the filaments 20 from one filament forming position any two adjacent outlets 89 can be used. The other outlets 89 can be shut off from the sizing supply by plugging the feed passageway 81 or by shutting off the pump that supplies sizing to those outlets 89. The applicator 84 can also be used to coat the filaments 20 from two forming positions. This is done by using all four of the outlets 89 to supply sizing to the roll 60. This coats the roll 60 with a sheet of sizing material that is large enough to coat the filaments 20 from two forming positions.

Figure 10:
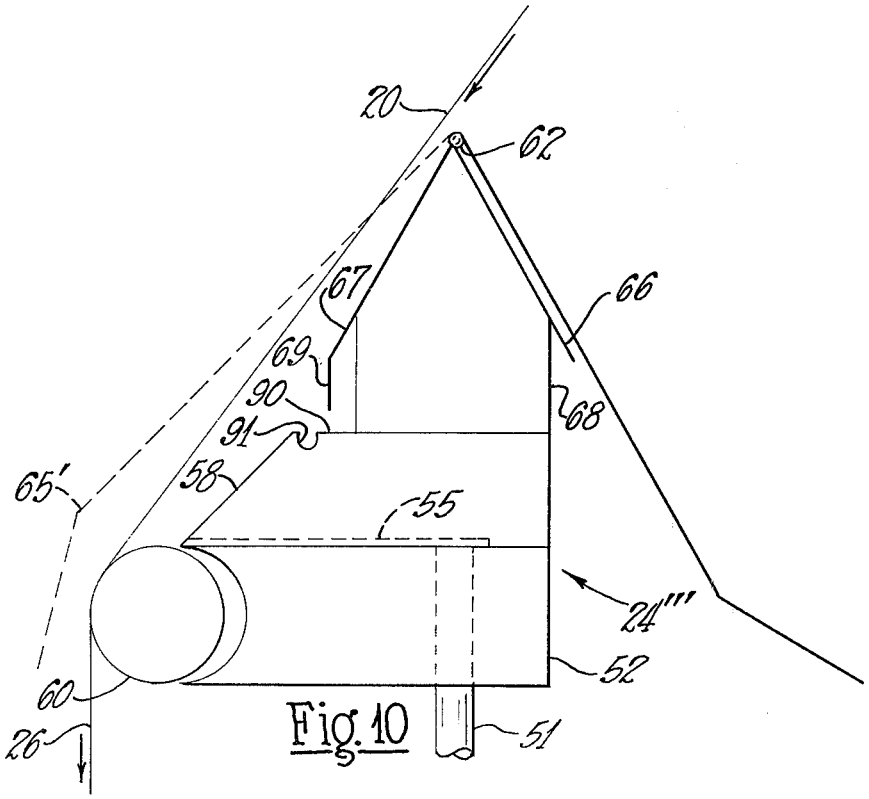
FIG. 10 is a side view of the applicator with the air control apparatus in position.

FIG. 10 shows the air diverting mechanism of the applicator 24''' in more detail. When filaments 20 are being attenuated at high speeds there is a lot of air tha is carried along with the filaments. This air travels along with the filaments 20 until the applicator is reached. The applicator tends to block the flow of the entrained air. This causes a great deal of turbulence in the area where the sizing material is applied. The entrained air can even blow the sizing off the filaments 20 and the applicator roll 60. Also the entrained air contains moisture or humidity from the surrounding atmosphere and the moisture can come into contact with the roll 60. The depositing of the moisture on the roll 60 results in a non-uniform coating or film of sizing on the roll 60. In addition when the filaments 20 are drawn across the roll 60 in an area where there are drops of water the filaments 20 are not coated with sizing. In any event the moisture in the entrained air impairs the uniform coating ability of the applicator 24'''. The problems associated with entrained air is made worse when the drive unit for the applicator roll 60 is located behind the applicator. Under these circumstances the drive unit also blocks the flow of the entrained air. This just compounds the problems associated with the entrained air.

To solve this problem with entrained air an air diverter has been installed on the applicator 24'''. There is a support 68 upon which the air diverting panels are mounted. The main air diverter is the panel 65 that is connected to the support 68 by means of a hinge 62. As the entrained air is carried along with the filaments 20 it strikes the edge of the panel 65 that is hinged to the support 68. This edge protrudes into the air stream being carried along with the filaments 20 and diverts a major portion of the entrained air. The diverted air is carried along the panel 65 and discharged off the opposite end of the panel 65 (see FIG. 1). The air is discharged into an area where it has no effect on the coating of the filaments 20.

Although the air diverting panel 65 removes a great deal of the entrained air it does not remove all of it. Therefore, the effects of the remaining entrained air must be minimized. The panel 67 that is located above the roller 60 is used to minimize the effects of the remaining entrained air.

The panel 67 has two sections for diverting some of the remaining moist or humid entrained air. The top of the panel 67 directs the air so it generally follows the path of the advancing filaments 20. The end or bottom region 69 of the panel 67 diverts the entrained air so it no longer follows the path of the advancing filaments 20. Instead the air is directed to a generally downward direction that varies from the direction of the advancing filaments 20. The moisture entrained air, once it is diverted to a generally downward direction, then strikes the top region 90 of the applicator 24'''. When the entrained air strikes or impinges upon the top region 90 a major portion of the moisture is removed from the air. Therefore, the problem of getting moisture, from the entrained air, on the roll 60 is substantially reduced.

The top region 90 of the applicator 24' has a groove 91. The groove 91 extends across the width of the applicator and slopes to one side of the applicator. The moisture removed from the entrained air as it impinges upon the top region 90 collects in the groove 91. The slope of the groove 91 then carries the moisture to the side of the applicator 24'''. The moisture can be disposed of once it reaches the side of the applicator without interfering with the filament coating operation.

The deflector panel 65 is mounted to the support 68 by a hinge. When the applicator 24''' is not being used to coat filaments the panel 65 can be swung around to cover the roll 60 and the rest of the applicator front. This leaves the panel 66 to cover the back of the applicator 24'''. The panel 65 can be used to protect the front of the applicator when it is not in use. This is especially important as molten glass will drip from the orifices 18 (FIG. 1) when the forming station is first shut down. The panels 65 and 66 act to divert the molten glass off of the applicator and to protect it from other foreign material or disturbances.

Having described the invention in detail and with reference to particular materials, it will be understood that such specifications are given for the sake of explanation. Various modifications and substitutes other than those cited may be made without departing from the scope of the invention as defined by the following claims.

I claim:

1. Apparatus for applying liquid to filaments comprising:

a body having a passageway with an elongated outlet and an exterior groove spaced below the outlet, the groove extending in a direction lengthwise of the outlet;

a rotatable applicator member for supplying liquid to filaments passed thereacross, the member being mounted in the exterior groove so that a portion of the member projects from the groove below the outlet so that filaments can be passed across the portion of the member that projects from the groove;

a means for rotating the applicator member in a direction such that the surface at the upper side of the member at the outlet moves away from the groove during rotation; and means for supplying liquid under pressure to the passageway of the body to discharge the liquid from the outlet onto the surface of the member at the upper side and on that portion of the member that projects from the groove so that during rotation the liquid is carried directly to filaments that are passed across the portion of the member that projects from the groove.

2. Apparatus of claim 1 wherein the applicator member is a cylindrical applicator roll.

3. Apparatus of claim 1 wherein the applicator member is cantilever mounted.

4. Apparatus of claim 3 wherein the groove is semicircular in shape.

5. Apparatus of claim 4 wherein the semicircular groove has the same size diameter as the diameter of the cylindrical applicator roll and the roll is mounted so that its axis of rotation is laterally displaced from the center of the circle defining the surface of the groove.

6. Apparatus of claim 5 wherein the axis of rotation of the cylindrical applicator roll is laterally displaced .015 of an inch from the center of the circle defining the surface of the groove.

7. Apparatus of claim 5 wherein the space between the surface of the applicator roll and the exterior edge of the groove is .005 of an inch.

8. Apparatus of claim 5 wherein more than one-half of the diameter of the applicator roll projects from the groove.

9. Apparatus of claim 1 wherein the liquid material is supplied to the passageway by a positive displacement pump.

10. Apparatus of claim 1 wherein the liquid material is a thixotropic gel.

11. Apparatus of claim 1 wherein the liquid material is a liquid sizing having a viscosity of at least 200 centipoise.

12. Apparatus of claim 1 wherein the passageway has sidewalls and these sidewalls make an angle of 35°–48° with a line extending perpendicular to the outlet.

13. Apparatus of claim 12 wherein the portion of the sidewalls immediately adjacent the outlet are perpendicular to the outlet.

14. Apparatus of claim 12 wherein a one-eighth of an inch portion of the sidewalls immediately adjacent the outlet is perpendicular to the outlet.

15. Apparatus for supplying liquid to filaments comprising:

a body having a passageway with an elongated outlet and an exterior groove spaced below the outlet, the groove extending in a direction lengthwise of the outlet, a rotatable applicator member for supplying liquid to filaments passed thereacross, the member being mounted in the exterior groove so that a portion of the member projects from the groove below the outlet, the applicator member being of such weight and being so mounted that it is rotated by contact with the filaments during their advancement across the portion of the member that projects from the groove; and means for supplying liquid under pressure to the passageway of the body for discharge from the outlet onto the surface of the member at the upper side and on that portion of the member that projects from the groove so that during rotation the liquid is carried away from the groove directly to filaments that are advanced across the portion of the member that projects from the groove.

16. Apparatus of claim 15 wherein the applicator member is a cylindrical applicator roll.

17. Apparatus of claim 15 wherein the applicator member is cantilever mounted.

18. Apparatus of claim 16 wherein the groove is semicircular in shape.

19. Apparatus of claim 18 wherein the semicircular groove has the same diameter as the diameter of the cylindrical applicator roll and the roll is mounted so that its axis of rotation is laterally displaced from the center of the circle defining the surface of the groove.

20. Apparatus of claim 19 wherein the axis of rotation of the cylindrical applicator roll is laterally displaced .015 of an inch from the center of the circle defining the surface of the groove.

21. Apparatus of claim 15 wherein the liquid material is a thixotropic gel.

22. Apparatus of claim 15 wherein the liquid material is a liquid sizing having a viscosity of at least 200 centipoise.

23. Apparatus for applying liquid sizing material to filaments comprising:

a body having a passageway with a rectangular elongated outlet and a semicircular exterior groove spaced below the outlet, the semicircular groove extending in a direction lengthwise of the outlet;

a cylindrical rotatable applicator roll for supplying sizing to the filaments passed thereacross, the member being mounted in the exterior groove so that a portion of the roll projects from the groove below the outlet so that the filaments can be passed across the portion of the roll that projects from the groove and the roll has the same diameter as the diameter of the groove and is laterally displaced from the groove;

a motor for rotating the applicator roll in a direction such that the circumferential surface at the upper side of the roll at the outlet moves away from the groove during rotation; and a positive displacement pump for supplying liquid sizing material under pressure to the passageway of the body to discharge the liquid sizing from the outlet so that the sizing is deposited onto the circumferential surface of the roll at the upper side and on that portion of the applicator roll that projects from the groove so that during rotation the liquid sizing is carried away from the groove directly to the filaments that are passed across the portion of the roll that projects from the groove.

24. Apparatus for applying liquid to glass filaments comprising:

a source of molten glass;

means for issuing streams of molten glass;

means for attenuating the streams of molten glass into filaments and collecting the filaments on a package;

a gathering member to gather the filaments into a strand before they are wound onto the package; and an applicator located above the gathering member for applying liquid to the glass filaments, the body of the applicator having a passageway with an elongated outlet and an exterior groove spaced below the outlet, the groove extending in a direction lengthwise of the outlet, a rotatable applicator member for supplying liquid to the filaments passed thereacross, the member being mounted in the exterior groove so that a portion of the member projects from the groove below the outlet so that the filaments can be passed across the portion of the member that projects from the groove, a means for rotating the applicator member in a direction such that the surface at the upper side of the member at the outlet moves away from the groove during rotation and means for supplying liquid under pressure to the passageway of the body to discharge the liquid from the outlet onto the surface of the member at the upper side and on that portion of the applicator member that projects from the groove so that during rotation the liquid is carried away from the groove directly to the filaments that are passed across the portion of the member that projects from the groove.

25. Apparatus for applying liquid to filaments comprising:

a body having a number of passageways with each passageway having an elongated outlet and an exterior groove spaced below the outlet, the groove extending in a direction lengthwise of the outlet;

a rotatable applicator member for supplying liquid to filaments passed thereacross, the member being mounted in the exterior groove so that a portion of the member projects from the groove below the outlets so that filaments can be passed across the portion of the member that projects from the groove;

a means for rotating the applicator member in a direction such that the surface at the upper side of the member moves at the outlet away from the groove during rotation; and means for supplying liquid under pressure to the passageway of the body to discharge the liquid from the outlet onto the surface of the member at the upper side and on that portion of the applicator member that projects from the groove so that during rotation the liquid is carried directly to filaments passed across the portion of the member that projects from the groove.

26. Apparatus of claim 25 wherein there are individual means to supply liquid to each passageway.

27. Apparatus of claim 26 wherein the means for supplying liquid to the passageways are positive displacement pumps.

28. Apparatus of claim 25 wherein there is one positive displacement pump to supply liquid to the passageways.

29. Apparatus of claim 25 wherein the body has two passageways with each passageway having an elongated outlet and the outlets are adjacent to one another.

30. Apparatus of claim 25 wherein the body has four passageways with each passageway having an elongated outlet and the outlets are adjacent to one another.

31. Apparatus for applying liquid sizing material to glass filaments comprising:

a source of molten glass;

a series of orifices for issuing streams of molten glass;

a winder for attenuating the streams of molten glass into filaments and collecting the filaments on a package;

a gathering member to gather the filaments into a strand before they are wound onto the package; and an applicator located above the gathering member for applying liquid sizing material to glass filaments; the body of the applicator having a passageway with a rectangular elongated outlet and a semicircular exterior groove spaced below the outlet, the groove extending in a direction lengthwise of the outlet, a cylindrical rotatable graphite applicator roll for supplying sizing to the filaments passed thereacross, the applicator roll being cantilever mounted in the exterior groove so that a portion of the roll projects from the groove below the outlet so that filaments can be passed across the portion of the roll that projects from the groove, the roll has the same diameter as the diameter of the semicircular groove and is mounted so that its axis of rotation is laterally displaced from the center of the circle defining the surface of the groove, a motor laterally offset from the body for rotating the applicator roll in the direction that the filaments travel such that the circumferential surface at the upper side of the roll at the outlet moves away from the groove during rotation and a positive displacement pump for supplying liquid sizing material under pressure to the passageway of the body to discharge the liquid sizing material from the outlet onto the circumferential surface of the roll at the upper side and on that portion of the applicator roll that projects from the groove so that during rotation the liquid sizing is carried away from the groove directly to the filaments that are passed across the portion of the roll that projects from the groove.

32. Apparatus for applying liquid to filaments comprising:

a hollow body having a cavity with an elongated outlet and an exterior groove spaced below and immediately adjacent the outlet, the groove extending in a direction lengthwise of the outlet;

a rotatable member for supplying liquid to filaments passed thereacross, the member being mounted in the exterior groove so that a portion of the member projects from the groove immediately adjacent the outlet so that filaments can be passed across the portion of the member that projects from the groove;

a means for rotating the member in a direction such that the surface at the upper side of the member moves at the outlet away from the groove during rotation; and means for supplying liquid under pressure to the cavity of the body to discharge the liquid from the outlet onto the surface of the member at the upper side and on that portion of the member that projects from the groove so that during rotation liquid is carried away from the groove directly to filaments passed across the portion of the members that projects from the groove.

33. Apparatus for applying liquid to filaments in a moist atmosphere comprising:

a body having a passageway with an elongated outlet and an exterior groove spaced below the outlet, the groove extending in a direction lengthwise of the outlet;

a rotatable applicator member for supplying liquid to filaments passed thereacross the member being mounted in the exterior groove so that a portion of the member projects from the groove below the outlet so that filaments can be passed across the portion of the member that projects from the groove;

a means for rotating the applicator member in a direction such that the surface at the upper side of the member at the outlet moves away from the groove during rotation;

means for supplying liquid under pressure to the passageway of the body to discharge the liquid from the outlet onto the surface of the member at the upper side and on that portion of the applicator member that projects from the groove so that during rotation the liquid is carried directly to filaments passed across the portion of the member that projects from the groove; and a means for diverting moist air moved with the filaments mounted on top of the body having two panels that diverge from their point of connection, the point of connection of the two panels being in close proximity to the advancing filaments wherein the first panel is positioned so it diverts a major portion of the moist air away from the advancing filaments and the second panel acts to divert a portion of the remaining moist air so it impinges upon the top surface of the body so as to remove the moisture from the air.

34. Apparatus of claim 33 wherein there is a groove along the width of the top of the body to remove the moisture deposited on the top of the body by the impinging moist air.

35. Apparatus of claim 34 wherein the groove slopes to one side of the body.

36. Apparatus of claim 33 wherein the moist air impintes upon the surface of the body in an area that is located generally above the applicator member and the outlet.

37. Apparatus for applying liquid to filaments comprising:

a body having a passageway with an elongated outlet and an exterior groove spaced below the outlet, the groove extending in a direction lengthwise of the outlet;

a rotatable applicator member for supplying liquid to filaments passed thereacross the member being mounted in the exterior groove so that a portion of the member projects from the groove below the outlet so that filaments can be passed across the portion of the member that projects from the groove;

a means for rotating the applicator member in a direction such that the surface at the upper side of the member at the outlet moves away from the groove during rotation;

means for supplying liquid under pressure to the passageway of the body to discharge the liquid from the outlet onto the surface of the member at the upper side and on that portion of the applicator member that projects from the groove so that during rotation the liquid is carried away from the groove directly to filaments passed across the portion of the member that projects from the groove; and an air diverter mounted on top of the body for diverting the moist air moved with the filaments at one side thereof having two connected panels that diverge from their point of connection, the point of connection being in close proximity to the advancing filaments, a hinge at the point of connection of the first two panels, a third panel attached to the point of connection of the first two panels by the hinge wherein the third panel is positioned above the first panel so it diverts a major portion of the moist air away from the one side of the advancing filaments and the second panel acts to divert a portion of the remaining moist air so it impinges upon the top surface of the body so as to remove the moisture from the air.

38. Apparatus of claim 37 wherein the third panel may be rotated around upon its hinge connection so it rest upon the second panel and extends over the applicator member and outlet so as to be in a position to protect the filament coating apparatus from damage when the apparatus is not in operation.

39. Apparatus of claim 37 wherein there is a groove along the width of the top of the body to remove the moisture from the area where the second panel causes entrained air to impinge upon the body.

40. Apparatus for forming and treating glass filaments with a liquid in a moist atmosphere comprising:

means for supplying streams of molten glass;

means for attenuating the streams into glass filaments at a sufficiently high speed to cause moist air to travel with the advancing filaments;

means for gathering the filaments into a strand;

an applicator located above the gathering means for applying liquid to the filaments as the filaments advance towards the gathering means, the applicator including a surface across which the filaments are passed for transferring coating liquid thereto and means for supplying liquid to the surface;

an air control means above the applicator for reducing air disturbances at the liquid supplying surface of the applicator, such means including a first surface oriented to extend in a direction generally transversly to the path of the filaments at a location effective to deflect some of the moist air moved by the filaments during their advancement and a second surface extending generally parallel to the direction of filament travel to direct moist air between it and the filaments; and an air impingement surface disposed above the liquid applying surface and across the movement of air between the second surface and the filaments so that such air impinges upon the surface and thereby reduces the effect of the moist air on the liquid applying surface of the applicator and having a groove along the width of the air impingement surface to remove the moisture deposited on the surface by the impinging moist air.

41. Apparatus of claim 40 wherein the first surface is oriented in an oblique fashion to the path of the filaments.

42. Apparatus of claim 40 wherein the first and second surfaces are planar surfaces.

43. Apparatus of claim 40 wherein the air impingement surface is the top surface of the applicator.

44. Apparatus for applying liquid to filaments in a moist atmosphere comprising:

a body having a passageway with an elongated outlet and an exterior groove below the outlet, the groove extending in a direction lengthwise of the outlet;

a rotatable applicator member for supplying the liquid to filaments passed thereacross the member being mounted in the exterior groove so that a portion of the member projects from the groove below the outlet;

a means for rotating the applicator member in a direction such that the surface of the upper side of the member at the outlet moves away from the groove during rotation;

means for supplying liquid under pressure to the passageway of the body to discharge the liquid onto the surface at the upper side of the applicator member during rotation so that the liquid is carried to the filaments passed across the surface; and a means for diverting moist air moved with the filaments mounted on top of the body having two panels that diverge from their point of connection, the point of connection of the two panels being in close proximity to the advancing filaments wherein the first panel is positioned so it diverts a major portion of the moist air away from the advancing filaments and the second panel acts to divert a portion of the remaining moist air so it impinges upon the top surface of the body so as to remove the moisture from the air, and having a groove along the width of the top of the body to remove the moisture deposited on the top of the body by the impinging moist air.

45. Apparatus of claim 44 wherein the groove slopes to one side of the body.

46. Apparatus for applying liquid to filaments comprising:

a body having a passageway with an elongated outlet and an exterior groove below the outlet, the groove extending in a direction lengthwise of the outlet;

a rotatable applicator member for supplying the liquid to filaments passed thereacross the member being mounted in the exterior groove so that a portion of the member projects from the groove below the outlet;

a means for rotating the applicator member in a direction such that the surface at the upper side of the member at the outlet moves away from the groove during rotation;

means for supplying liquid under pressure to the passageway of the body to discharge the liquid onto the surface at the upper side of the applicator member during rotation so that the liquid is carried to the filaments passed across the surface;

an air diverter mounted on top of the body for diverting the moist air moved with the filaments at one side thereof having two connected panels that diverge from their point of connection, the point of connection being in close proximity to the advancing filaments, a hinge at the point of connection of the first two panels, a third panel attached to the point of connection of the first two panels by the hinge wherein the third panel is positioned above the first panel so it diverts a major portion of the moist air away from the one side of the advancing filaments and the second panel acts to divert a portion of the remaining moist air so it impinges upon the top surface of the body so as to remove the moisture from the air; and wherein the third panel may be rotated around upon its hinge connection so it rest upon the second panel and extends over the applicator member and outlet so as to be in a position to protect the filament coating apparatus from damage when the apparatus is not in operation.

47. Apparatus for applying liquid to filaments comprising:

a body having a passageway with an elongated outlet and an exterior groove below the outlet, the groove extending in a direction lengthwise of the outlet;

a rotatable applicator member for supplying the liquid to filaments passed thereacross the member being mounted in the exterior groove so that a portion of the member projects from the groove below the outlet;

a means for rotating the applicator member in a direction such that the surface at the upper side of the member at the outlet moves away from the groove during rotation;

means for supplying liquid under pressure to the passageway of the body to discharge the liquid onto the surface at the upper side of the applicator member during rotation so that the liquid is carried to the filaments passed across the surface;

an air diverter mounted on top of the body for diverting the moist air moved with the filaments at one side thereof having two connected panels that diverge from their point of connection, the point of connection being in close proximity to the advancing filaments, a hinge at the point of connection of the first two panels, a third panel attached to the point of connection of the first two panels by the hinge wherein the third panel is positioned above the first panel so it diverts a major portion of the moist air away from the one side of the advancing filaments and the second panel acts to divert a portion of the remaining moist air so it impinges upon the top surface of the body so as to remove the moisture from the air; and having a groove along the width of the top of the body to remove the moisture from the area where the second panel causes the moist air to impinge upon the body.

* * * * *